US006193826B1

(12) United States Patent
Starr et al.

(10) Patent No.: US 6,193,826 B1
(45) Date of Patent: Feb. 27, 2001

(54) TILE ROOF CONSTRUCTION OBTAINED USING ONE-COMPONENT WITH ADHESIVE PATTERN

(75) Inventors: Cris Damon Starr, Cape Coral, FL (US); Gary Grunauer, Highland, IN (US)

(73) Assignee: Insta-Foam Products, Inc., Marietta, GA (US)

( * ) Notice: Subject to any disclaimer, the term of this patent is extended or adjusted under 35 U.S.C. 154(b) by 0 days.

(21) Appl. No.: 09/248,518

(22) Filed: Feb. 9, 1999

Related U.S. Application Data

(62) Division of application No. 08/649,450, filed on May 17, 1996, now Pat. No. 5,895,536.

(51) Int. Cl.[7] ..... E04D 1/00; E04D 1/34

(52) U.S. Cl. ..... 156/71; 52/535; 52/540; 52/746.1

(58) Field of Search ..... 52/518, 535, 540, 52/543, 746.1, 748.1; 156/71

(56) References Cited

U.S. PATENT DOCUMENTS

| | | | | |
|---|---|---|---|---|
| 2,667,131 | * | 1/1954 | Clarvoe et al. . | |
| 3,080,683 | * | 3/1963 | Sallie . | |
| 5,362,342 | * | 11/1994 | Murray et al. | 156/71 |
| 5,465,547 | * | 11/1995 | Jakel | 52/518 |
| 5,582,898 | * | 12/1996 | Kiser | 428/143 |

* cited by examiner

*Primary Examiner*—Sam Chuan Yao
(74) *Attorney, Agent, or Firm*—Vedder Price Kaufman & Kammholz

(57) ABSTRACT

A method of adhering roof tiles to a roof utilizes a one-component adhesive and in particular, a one-component polyurethane adhesive foam applied to the undersurfaces of the roof tiles in a discontinuous patterns. The adhesive is applied in the form of separate deposits at opposing corners of the undersurfaces of the roof tiles and the roof tiles are laid on the roof in serial fashion and overlapping courses.

19 Claims, 3 Drawing Sheets

TILE ROOF CONSTRUCTION OBTAINED USING ONE-COMPONENT WITH ADHESIVE PATTERN

REFERENCE TO RELATED APPLICATION

This application is a divisional application of prior U.S. application Ser. No. 08/649,450, filed May 17, 1996 now U.S. Pat. No. 5,895,536.

BACKGROUND OF THE INVENTION

The present invention relates generally to methods of roof construction, and more particularly relates to an improved method for adhering roof tiles to substrates using economical one-component adhesives, including one-component high-density polyurethane adhesive foams.

Roof construction, especially in residential construction, varies by location throughout the United States. In the northern climates, most roofs utilize a thin covering of tar paper-based shingles or thick wooden shingles as a final covering for the roof. In southern climates, tiles are used as the final covering of the roof. These roof tiles may be made from a variety of materials, including synthetic materials, such as plastics, and natural materials, such as stone, concrete, clay, ceramic and fired brick. In the application of these latter types of roof tiles, mortars or cementitious materials have been used in the past to apply the roof tiles to the roof substrate.

The use of mortars as roof tile adhesives is expensive because the mixing and application of the mortar is very labor intensive. Mortars are dense materials and their use as roof adhesives increases the load placed on the roof. The curing time for mortar may also be relatively long, thereby hampering quick completion of the roof. A need therefore exists for a lighter adhesive which is less labor intensive than mortar and which lends itself to efficient application of roof tiles.

Adhesives, and in particular adhesive foams, have been developed to replace mortars used in roof construction. U.S. Pat. No. 5,362,342, issued Nov. 8, 1994 describes the use of a two-component polyurethane foam to bond roof tiles to a substrate. This patent further describes the use of a bulky, complex pressurized dispensing system which is necessary to mix the two components together so that they may react to create a sufficient amount of foam with the desired adhesive characteristics. The aforesaid '342 patent further describes a particular method of using two-component foams to bond roof tiles to a roof substrate in which thick, linear beads of foam are applied to the entire length of the roof tiles.

One-component adhesives, such as those sold under the trade name INSTA-STIK by Insta-Foam of Joliet, Illinois have been utilized in the past, primarily for adhering roof insulation boards to roof substrates. These one-component adhesives are collapsible foams and are applied in long beads of foam for all or most of the entire length of the insulation boards to adhere the insulation boards to the roof. The use of long, linear beads of adhesives increases the cost of applications by using large amounts of adhesives and lengthening the application process.

The present invention is directed to a roof tile adhesion method which uses inexpensive one-component adhesives, and in a preferred embodiment one-component polyurethane adhesive foams, in a novel application pattern which significantly reduces the amount of adhesive used per roof tile without detracting from its adhesive strength.

It is therefore an object of the present invention to provide a method of adhering roof tiles to a roof substrate using economical one-component adhesives, including one-component adhesive foams.

Another object of the present invention is to provide a method for adhering roof tiles to a substrate using a modest amount of adhesive in a unique pattern which reduces the amount of adhesive used for application, yet provides sufficient adhesive strength between the roof tile and the substrate.

Yet another object of the present invention is to provide a method for adhering roof tiles to a substrate by applying a one-component, high-density polyurethane adhesive foam to opposing corners of the roof tile and placing the tiles into contact with the substrate, and letting the adhesive foam cure to adhere the roof tile to the substrate.

Still yet another object of the present invention is to provide an improved tiled roof construction having a substrate, a plurality of roof tiles adhered to the substrate, the roof tiles being adhered to the substrate by an adhesive deposited in alignment with opposing corners of the roof tiles, the adhesive deposits having a pad-like profile, the adhesive pads adhering opposite corners of the tile to the roof substrate and a preceding tile course, the adhesive pads further defining a discontinuous adhesive pattern which does not subdivide the space between the tile undersurfaces and the roof substrate into discrete spaces to restrict air circulation between the roof tile and the roof substrate.

SUMMARY OF THE INVENTION

In one principal aspect of the present invention, a roof construction method is provided in which successive courses of roof tile are adhered to a roof substrate by applying a one-component adhesive to the undersurface of the roof tiles; laying the tiles in successive courses on the roof; and, permitting the foam to cure.

In another principal aspect of the present invention and as exemplified in one preferred embodiment, a method for applying roof tiles to a roof substrate is provided which includes the steps of: providing a one-component adhesive, particularly a one-component adhesive foam; applying a first course of roof tile to a roof substrate by depositing the adhesive in a discontinuous pattern comprising two separate deposits in registration with opposite corners of the roof tiles; adhering the first course of roof tiles to the roof substrate by placing the first course of roof tiles onto the roof substrate to effect contact between the adhesive deposits, the roof tiles and the roof substrate; dispensing a series of second deposits of the adhesive in registration with opposite corners of the undersurfaces of a second course of roof tiles; placing the second course of roof tiles over the roof substrate and the first course of roof tiles such that the tail portions thereof and adhesive deposits aligned therewith contact the roof substrate and the head portions thereof and adhesive deposits aligned therewith overlie and contact the first course of roof tiles; and, permitting the adhesive to cure such that the first and second roof tile courses become adhered to roof substrate.

In another principal aspect of the present invention and as exemplified by another embodiment of the invention, a roof construction includes a roof substrate and a plurality of roof tiles attached to the substrate in successive courses, each of the tiles being attached to the roof substrate by discontinuous deposits of a one-component adhesive aligned with opposing corners of the undersurfaces of roof tiles, the adhesive foam deposits spacing the tiles partially away from the roof substrate so as to create an air channel therebetween.

These and other objects, features and advantages of the present invention will be apparent through a reading of the following detailed description, taken in conjunction with accompanying drawings, wherein like reference numerals refer to like parts.

BRIEF DESCRIPTION OF THE DRAWINGS

In the course of the description, reference will be made to the attached drawings in which.

DESCRIPTION OF THE PREFERRED EMBODIMENTS

Figure 1:
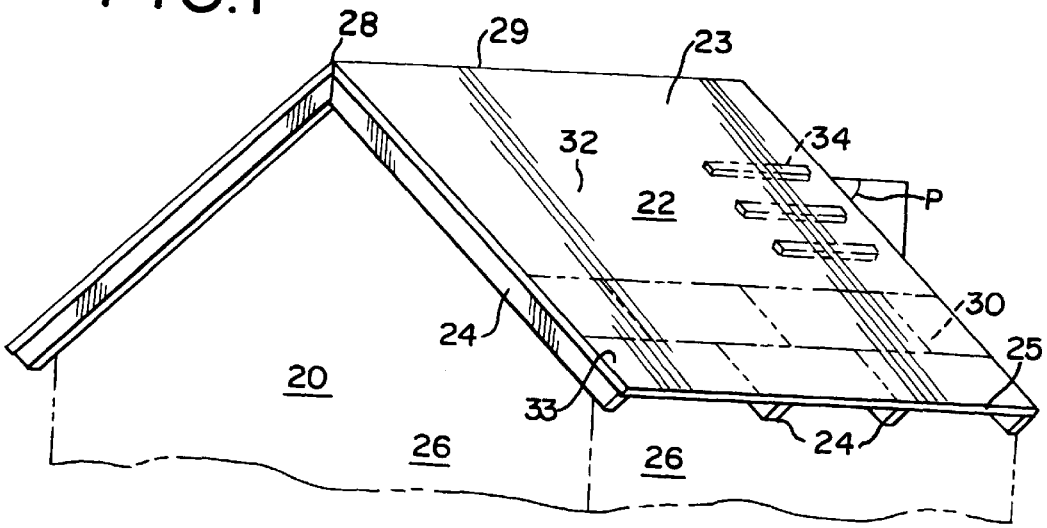
FIG. 1 illustrates a typical pitched roof upon which roof tiles are attached.

FIG. 1 illustrates a structure 20 having a roof 22 disposed thereon at a particular angle, or pitch P. The roof 22 includes a substrate 23 is supported on the structure 20 by a series of structural members, shown as roof joists 24 which are spaced apart from each other along the walls 26 of the structure. The roof joists 24 extend from the edge, or eave 25 of the roof upwardly at the pitch P and may be connected to a central ridge beam 28 at the apex 29 of the roof in a conventional manner.

The roof substrate 22 is commonly of a multiple layer construction and may include sheathing, or decking 30, in the form of plywood, particle board, cement boards or the like which is preferably fixed to the joists 24 such as by nailing. This sheathing 30 serves as a support surface for the final covering, or cap sheet, of the roof 22. This covering may be a water resistant material 32, such as roofing felt or tar paper and is commonly referred to in the art as an "underlayment". When circumstances dictate, such as when the pitch of the roof is steep, the substrate 20 may further include a series of spaced-apart batten strips 34 (shown in phantom) laterally applied to its surface to provide engagement points for anchor lugs formed in the roof tiles to engage in order to prevent movement of the roof tile during application to the substrate 22.

Figure 2:
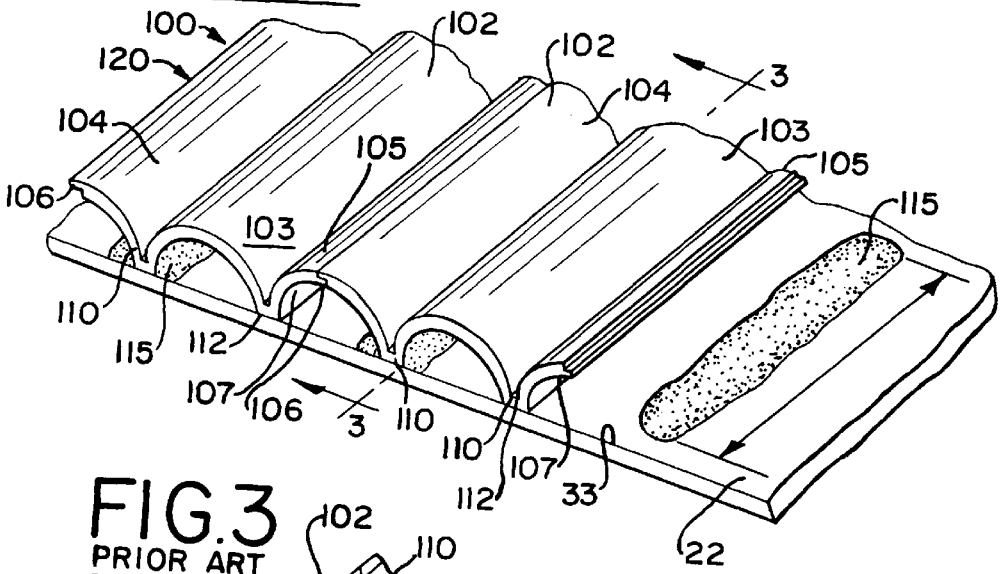
FIG.2 PRIOR ART
FIG. 2 is a perspective view of a segment of a prior art roof construction utilizing a two-component adhesive foam to adhere a roof tile course to a roof substrate using, continuous, linear beads of adhesive foam along the entire length of the roof tiles.
Figure 3:
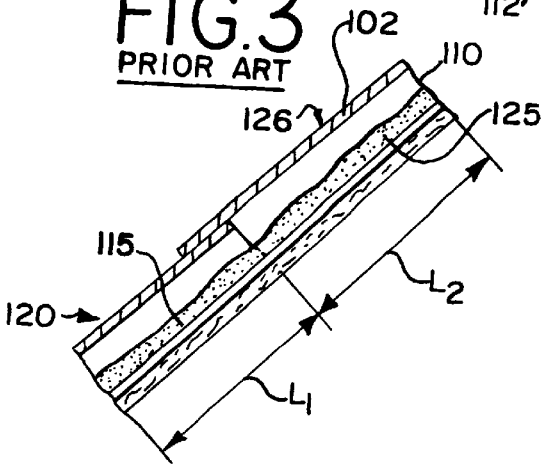
FIG.3 PRIOR ART
FIG. 3 is a sectional view of FIG. 2 taken along lines 3—3 thereof illustrating the longitudinal extent of the adhesive foam.

FIGS. 2 & 3 illustrate a prior art roof construction 100 which is typical of the construction described in U.S. Pat. No. 5,362,342, in which roof tiles 102 are adhered to a roof substrate 22. As described in the '342 patent, the construction 100 includes a plurality of low profile roofing tiles 102 having a Spanish-influenced design. Each roof tile 102 is rectangular in its exterior dimensions with a non-planar upper surface and has a hollow central semi-circular portion 103 flanked by two hollow quarter portions 104, 105 which include respective engagement edges 106, 107. The central semi-circular portion 103 and its flanking quarter portions 104, 105 meet together to define two support ribs 110 having a flat lower surface 112 which rest upon the exposed flat surface 33 of the roof 22.

As taught in the aforesaid '342 patent, a two-component foam is deposited onto the exterior surface 33 of the roof 22 in the form of a thick, linear bead '15 of foam. This thick bead 115 of adhesive foam extends for the entire length of the tiles 102. In the assembly of this type of roof construction, the foam bead 115 is used to apply a starter course 120 of roof tiles, and the length of the foam bead substantially matches the length $L_1$ of this first course 120 of tiles. Once the first course 120 has been applied, similar thick beads 125 having lengths $L_2$ which match the length of the second course 126 of tiles are applied to the roof substrate 23 and the first course 120 of tiles.

Although the use of the two-component foam 114 in this type of roof construction 100 is effective enough to adhere the roof tiles 102 in place upon the roof 22, such two-component foams are generally expensive. Furthermore, the teachings of the '342 patent direct one skilled in the art to apply an adhesive foam bead for the entire length or substantially the entire length of the tiles 116. This fashion of adhesive foam application promotes the use of more adhesive foam than necessary.

It has been discovered with the development of the present invention that a more economical one-component adhesive, including an adhesive foam, may be used to reliably adhere roof tiles to a roof substrate and in a particular pattern which uses significantly less adhesive than taught by the aforesaid '342 patent and other prior art roof-adhesive foam applications.

In an important aspect of the present invention, a one-component adhesive is utilized to adhere the roof tiles to the roof substrate. One advantage the use of one-component adhesives, especially one-component adhesive foams, have over two-components adhesive foams is cost. Another advantage is that one-component adhesives are dispensed from single pressurized containers, which avoids the use of maintaining separate adhesive foam components by the installer on site in inventory and the need for an elaborate and complex mixing, reacting and dispensing apparatus as are utilized with two-component adhesive foams an example of which is disclosed in the aforesaid '342 patent. Additionally, the methods of the present invention and, particularly the pattern used for the application of the adhesive, do not subdivide the undersurfaces of the roof tiles or the interstitial spaces between the undersurfaces and the roof substrate into discrete, areas which may inhibit the passage of air between the roof tile and the underlying roof substrate, and inhibit the opposing roof tile and substrate to grow and contract according to climatic conditions.

It has been found that the present invention significantly reduces the amount of adhesive needed to adhere a single roof tile to a roof substrate and further provides sufficient bonding strength to meet building code roof criteria. Table 1 which appears below in this detailed description, sets forth uplift test data for various profile roof tile using Tile Bond™ roof tile adhesive manufactured by Insta-Foam Products of Joliet, Illinois. This data indicates that the novel adhesive application pattern produces a sufficient uplift strength.

In another important aspect of the present invention, the one-component adhesive foam is dispensed onto the roof substrate and roof tiles in a discontinuous pattern so that the adhesive foam does not substantially subdivide the undersurfaces of each roof tile into discrete areas to thereby partially cut off air circulation as can the continuous, linear deposits of adhesive foam described in the aforesaid '342 patent. The adhesive foam is further concentrated in deposits at opposing corners of the underside of the roof tile.

Figure 7:
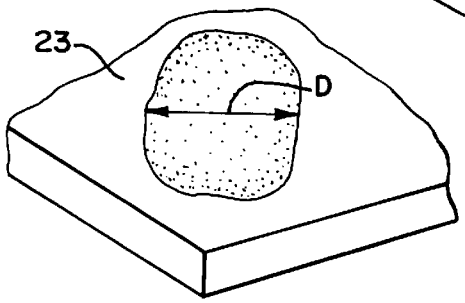
FIG. 7 is a view of a tennis-ball like adhesive deposit used in the present invention.
Figure 8:
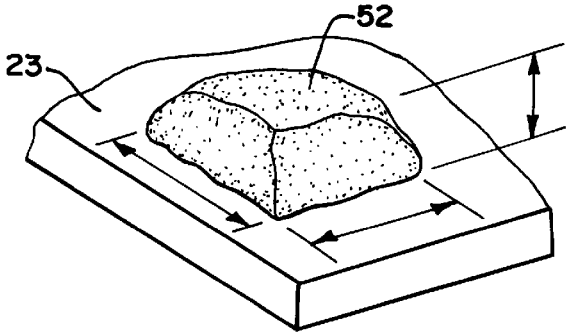
FIG. 8 is a view of a pad-like deposit of adhesive foam used in the present invention.

The adhesive deposits of the present invention shall be aptly characterized in this detailed description as "pads" or "pad-like" deposits because they may comprise circular or irregular shapes, rather than comprise continuous or linear, longitudinal beads. It has been found through testing, the results of which are set forth below, that such pads provides optimum adhesive strength as measured by uplift resistance force with minimal usage of the foam. The pads 50 may be generally circular in configuration and approximately the size of a tennis ball about 2½-inches in diameter D, such as is shown in FIG. 7. The adhesive pads may also have a generally rectangular pad-like configuration 52 of dimensions of about 1 inch high by 2 inches long by 3 inches wide as shown in FIG. 8. It shall be understood that the adhesive configurations illustrated in FIGS. 7 and 8 are merely exemplary of suitable deposits which have been demonstrated to provide the necessary uplift strength for use in roof tile attachment. Other discontinuous deposits may be utilized to achieve the same results.

It has also been noted that the use of these adhesive deposits in the particular pattern mentioned above not only reduces the amount of foam used, but also beneficially does not subdivide the undersurface of the roof tile and the interstitial space which occurs between the roof tile undersurfaces and the roof surface to restrict the passage of air therethrough in both the longitudinal and lateral directions ("X","Y"). Rather the present invention does not impart any such restrictive subdivision and thereby facilitates air passage which permits the roof substrate and tile to expand and contact harmoniously in various climatic conditions.

Testing of one particular adhesive, Tile Bond™ roof tile adhesive manufactured by Insta-Foam Products of Joliet, Ill., was performed on various profile roof tiles to determine the static uplift strength and moment resistance of the adhesive pattern of the present invention. This testing was performed in accordance with the Dade County (Florida) Testing Protocol PA 101-95 (JAN) "Test Procedure for Static Uplift Resistance of Mortar or Adhesive Set Tile Systems". This Tile Bond™ adhesive in a one-component, high-density polyurethane adhesive foam. This type of foam is a minimal expanding foam and has a density which ranges from about 1½ pounds per cubic foot to about 4 pounds per cubic foot. The density of this adhesive foam is increased when the roof tile is passed into contact with it. Greater density foams may be used up to about 10 pounds per cubic foot.

The testing was performed on roof panels constructed in accordance with that described in the PA 101-95 test protocol. The roof panels had dimensions of around 4 by 8 feet upon which 14 test tiles were applied using the Insta Foam Tile Bond™ roof tile adhesive foam described above. The test sections were constructed using nominal ½ inch plywood, American Plywood Association 32/16 sheathing having a thickness of 15/32 inches. The sheathing was nailed to 2-inch by 6-inch supports spaced at the perimeters of the sheathing and spaced on 24-inch centers in between. The nailing pattern was conventional using 8*d* (8-penny) common nails spaced on 6-inch centers along the perimeters of the panels and 12-inches within the panel.

An underlayment was applied to the sheathing after nailing which consisted of an ASTM D226, Type II anchor sheet with 12 gauge roofing nails and 1⅝-inch tin caps. The nailing pattern was a 12-inch grid pattern staggered in two rows of the roof panel field and 6-inch centers at any laps. An ASTM D249 mineral surface top ply sheet was attached to the anchor sheet by way of a coating of ASTM D312, Type IV asphalt and allowed to dry for 24 hours before the application of any tile systems. Thus underlayment is known in the art as a "standard 30/90" underlayment.

Two other underlayments were used in the tests. One underlayment consisted of a 40 mil thickness rubberized SBS modified asphalt sheet sold under the tradename Rainproof-40 by the Protectowrap Company. The other underlayment consisted of a standard two-ply 30 system using two layers of ASTM D226, Type II sheets and horizontal batten strips. These roofing sheets were lapped 19 inches over preceding sheets and mechanically attached to the roof sheathing using nails at 6-inch centers in rows of 18-inch centers.

A number of roof panels were constructed using the three types of underlayments described above and after the 24-hour period drying period, various profile roof tiles were attached in respective sets to each roof panel. A test hole was drilled in each of the test tiles of the panels and was located on the centerline of the roof tile at a distance of 0.76 times the length (i.e., 0.76×Length) of the tile from the head of the tile. A ¼-inch diameter concrete anchor screw was installed in this hole to provide a point on the roof tile to which a test load could be applied.

The tiles tested consisted of the second course of tiles, which were applied to a preceding roof tile course with a nominal 2-inch overlap. That is, the trailing edge of the roof tile was laid upon the leading edge of the preceding roof tile course. Fourteen test tiles were evaluated for each of Tests 1 through 4 on roof panels constructed using a standard 30/90 underlayment and twelve test tiles were evaluated for Tests 5 and 6 on roof panels using the rubberized SBS modified asphalt sheet and two-ply 30 system underlayments. Tile Bond™ adhesive was dispensed in a discontinuous pattern in registration with the opposite corners of the roof tiles.

Four different styles of roof tiles were tested from two different roof tile manufacturers. Those style tiles were the "Colonial", "Capri" and "Espana" styles manufactured by Lifetile and the "Villa" style tile manufactured by Monier. The adhesive dispenser was weighed after adhesive was applied to every 3 to 4 tiles in order to obtain an average value of the mass of adhesive used for each tile. The adhesive was allowed to cure overnight and then the roof tiles were tested to determine their uplift resistance.

A floor model Instron No. 1115 testing machine equipped with a 1000 lb load cell and chart recorder was used for testing the tiles. A chain was attached between the load cell of the Instron machine and the test screw of a particular tile. The roof panels were inclined at about 9.5° to emulate a roof pitch of 2:12, that is 2-inch rise for every 12-inch of horizontal extent. The test results are reproduced in Table 1 below:

TABLE 1

| TEST NUMBER & TILE STYLE | NUMBER OF TILES TESTED | TILE PROFILE | ROOF UNDERLAY-MENT | AVERAGE ADHESIVE AMOUNT (per tile) | AVERAGE ULTI-MATE LOAD (LBS) | MINIMUM RESIST-ANCE LOAD (LBS) | RESISTING MOVEMENT FT-LBS |
|---|---|---|---|---|---|---|---|
| 1- Colonial | 14 | Flat | 30/90 | 13.8 | 143.1 | 66.3 | 71.1 |
| 2- Capri | 14 | Low | 30/90 | 12.3 | 185.1 | 87.3 | 93.5 |
| 3- Espana | 14 | High | 30/90 | 9.8 | 131.8 | 60.2 | 65.0 |
| 4- Villa | 14 | Low | 30/90 | 14.2 | 223.3 | 107.0 | 111.2 |
| 5- Colonial | 12 | Flat | SBS Modified | 12.8 | 223.3 | 106.0 | 113.9 |
| 6- Colonial | 12 | Flat | 2-ply 30 with batten strips | 11.1 | 224.2 | 106.4 | 101.0 |

It can be seen from Table 1 that the average mass of adhesive used per tile varied between about 9 grams to about 15 grams (or about 4 grams to about 8 grams per adhesive deposit), yet the least minimum ultimate load obtained was about 130 lbs as reflected in Test 3. Other testing of one component adhesives using about 2 grams per desposit have yielded uplift failure values of about 100 pounds of force. Thus, it can be seen that the discontinuous pattern of the present invention provides sufficient uplift force resistance with a substantial reduction in foam amount.

Figure 4:
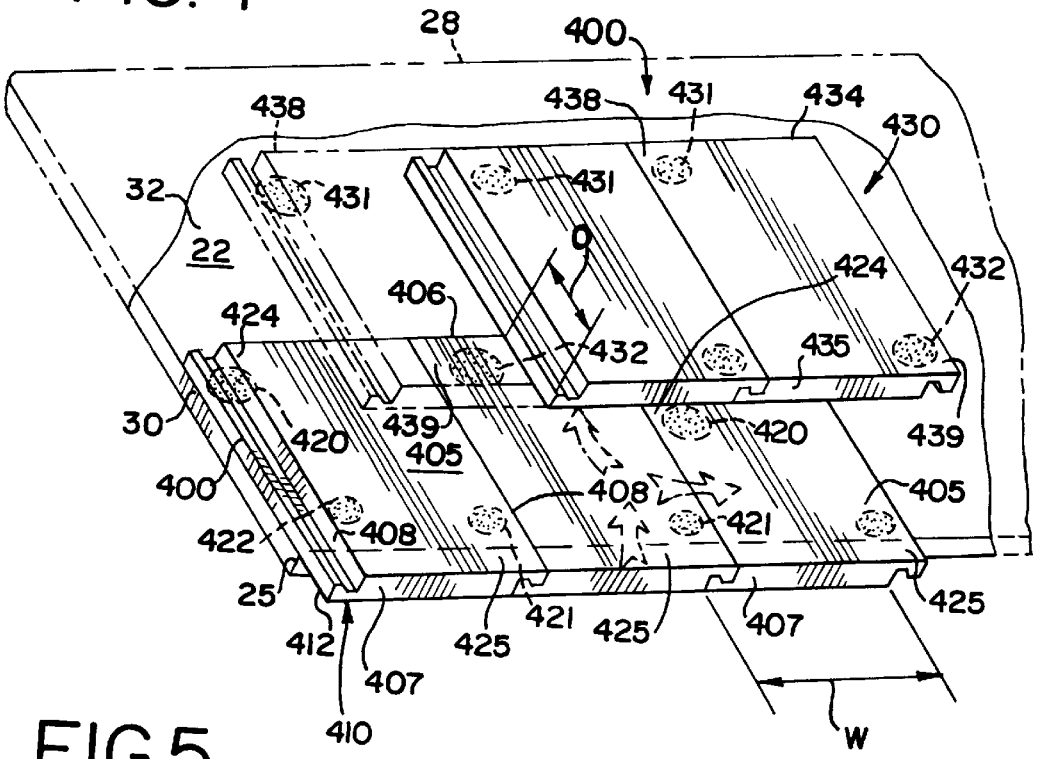
FIG. 4 is a perspective view of a section of a roof illustrating the placement of two courses of flat roof tiles installed thereon using the present invention.

Turning now to FIGS. 4–7, examples of various types of roof tiles and their adhesion to a roof using the present invention are illustrated. FIG. 4 illustrates a section 400 of a pitched roof using flat profile roof tiles similar in configuration to the "Colonial" tiles of Test 1 of Table 1. The roof substrate 22 is planar and includes support sheathing 30 covered by an underlayment 32. The roof section 400 depicted includes a lower eave 25 and the roof section 400 is angled upwardly at a preset pitch P up to a ridge 28 (shown in phantom).

In accordance with the present invention, a first set of roof tiles 405 is selected from a supply of tiles. The tiles 405 have opposing leading and trailing edges 406, 407 and side edges 408 which interconnect the leading and trailing edges 406, 407 together to define an overall rectangular configuration, the side edges 408 may include engagement members 410 as illustrated which permit the interconnection of adjacent ones of the first tiles 405. A discontinuous pattern of a one-component adhesive as previously described is used for attachment of these tiles 405 to the roof substrate 22. This pattern includes two separate adhesive deposits 420, 421 which are preferably aligned with each other near the opposite corners 424, 425 of the portions of the roof tiles 402 which oppose the roof 22 and near the leading and trailing edges 406, 407 thereof. The lower adhesive deposits 421 are positioned close to the eave 25 of the roof 400 on the first course tiles 405.

After the adhesive deposits 420, 421 are applied to either to the exterior surface 33 of the underlayment 32 or directly to the undersurfaces 412 of the first course tiles 405, the tiles 405 are placed onto the roof 400 so that contact is made between the adhesive deposits 420, 421, the roof tiles 405 and the roof underlayment 32. In this regard, the tiles 405 are preferably pushed down onto the adhesive deposits 420, 421 to effect a reliable contact with the underlayment 32. The adhesive deposits do not subdivide the interstitial spaces occurring between the roof tiles and the roof substrate into discrete areas such as is taught in the aforementioned U.S. Pat. No. 5,362,342 which division would restrict air and moisture flow therebetween. Rather, the adhesive deposits 420, 421 beneficially do not create any such subdivision so that the passage of air (and moisture) through the interstitial spaces is facilitated rather than inhibited as illustrated in the phantom arrows of FIG. 4. Flow of air and moisture through these interstitial areas 414 occurs as indicated by the arrows in FIGS. 4 & 8, and permits the roof substrate and tiles to expand and contract in accordance with climatic conditions.

A second set of roof tiles 430 is then selected and the discontinuous adhesive pattern is repeated. That is, two adhesive deposits 431, 432 are registered with the leading and trailing edges 434, 435 and opposite corners 438, 439 of a second course of tiles 430 in locations corresponding to the corner-corner arrangement illustrated in the upper left of FIG. 4. Once the adhesive is deposited (either on the tile themselves or the opposing roof or preceding tile surfaces), the second tiles 430 are positioned over the roof substrate 23 and the leading edges 406 of the first tiles 405 so that an overlap "O" occurs as illustrated as per the tile manufacturer's installation instructions. The second tiles 430 are then pressed down so that effective contact is made between their undersurfaces 433, the adhesive deposits 431, 432, and the roof substrate and first tile course overlap O. The second set 430 of tiles are further staggered, or offset, laterally a distance of approximately 50% of the width W of the tiles so that the interengaging side edges 436 of the tiles 430 are not aligned together in a line from the eave 25 of the roof up toward the ridge 28 of the roof 400.

In FIG. 4, it can also be seen that the first set of tiles 405 which are applied at the eave 25 of the roof 22 includes a portion 410 which overhangs the eave 25. The length of this overhang is commonly dictated by local building codes and a common overhang is in the order of 2 inches. Uplift forces may be exerted against these overhang portions 410 by high winds, and in order to provide an additional factor of safety for this first set of tiles 405 to counteract any such uplift forces, an additional adhesive deposit 422 may be applied in alignment with the remaining lower corner 426 of each of the tiles 405 of the first tile course near the trailing edges 407 thereof.

Figure 5:
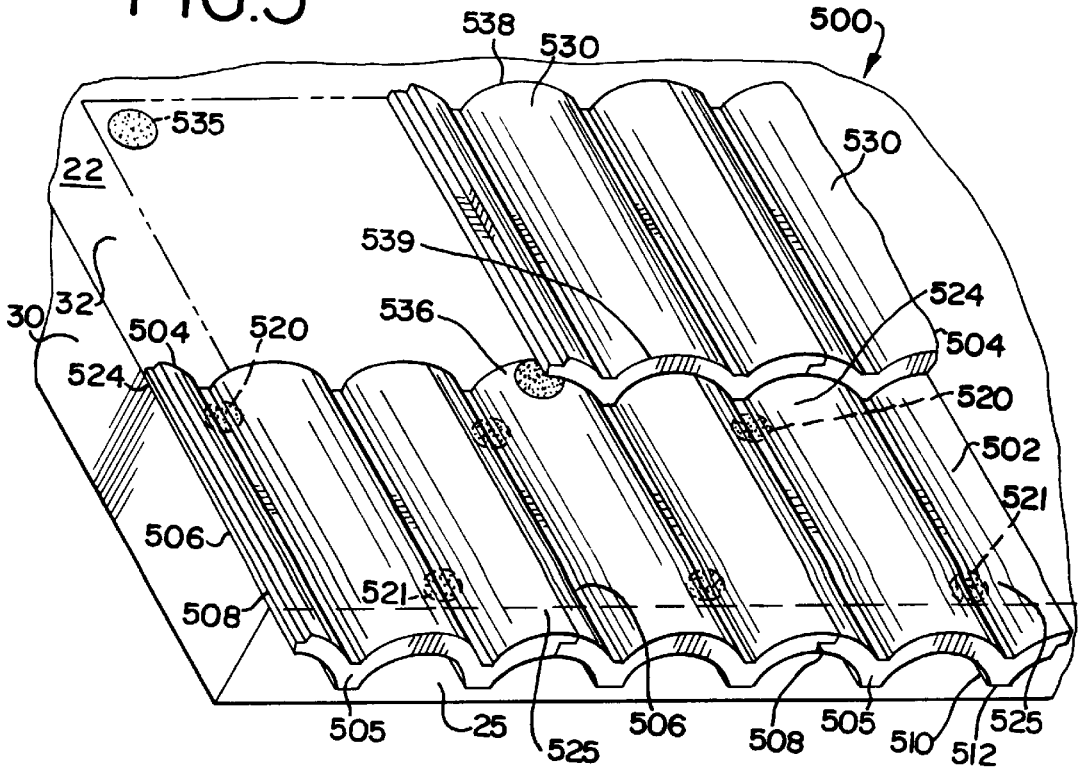
FIG. 5 is a perspective view of a section of a roof illustrating the placement of two courses of roof tiles installed using the present invention and used with low profile, non-planar roof tiles.

FIG. 5 illustrates another roof section 500 using a different profile tile. The tiles shown are a low profile tile similar to the "Capri" style tested in Test 2 of Table 1. The first course of tiles 502 have opposed leading and trailing edges 504, 505 and side edges 506 which interconnect the edges 504, 505. The side edges 506 include interlocking strips 508 which permit adjacent tiles to be interlocked together. The first tiles 502 further have a curved exterior configuration and in this regard, the undersurfaces 510 of the tiles 502 include ribs 512 which are intended to contact the roof substrate.

Utilizing the present invention, two adhesive deposits 520, 521 are positioned in a discontinuous pattern in alignment with and near the opposing corners 524, 525 and leading and trailing edges 504, 505 of the first tiles 502. The first tiles 502 are placed onto the substrate so that the adhesive deposits 520, 521 make effective contact between the substrate 23 and the tile undersurfaces 510. A second set of tiles 530 is selected and the adhesive is either applied to those tiles 530 or to the substrate 23 and to the overlap area 532 of the first tiles 502 in the discontinuous pattern of the invention, as exemplified by the two adhesive deposits 535, 536 shown exposed in the upper left of FIG. 5. The second tiles 530 are then applied onto the adhesive deposits 535, 536 so that the leading edges 538 of the tiles 530 oppose the roof substrate and the trailing edges 539 thereof oppose the first tiles 502.

Figure 6:
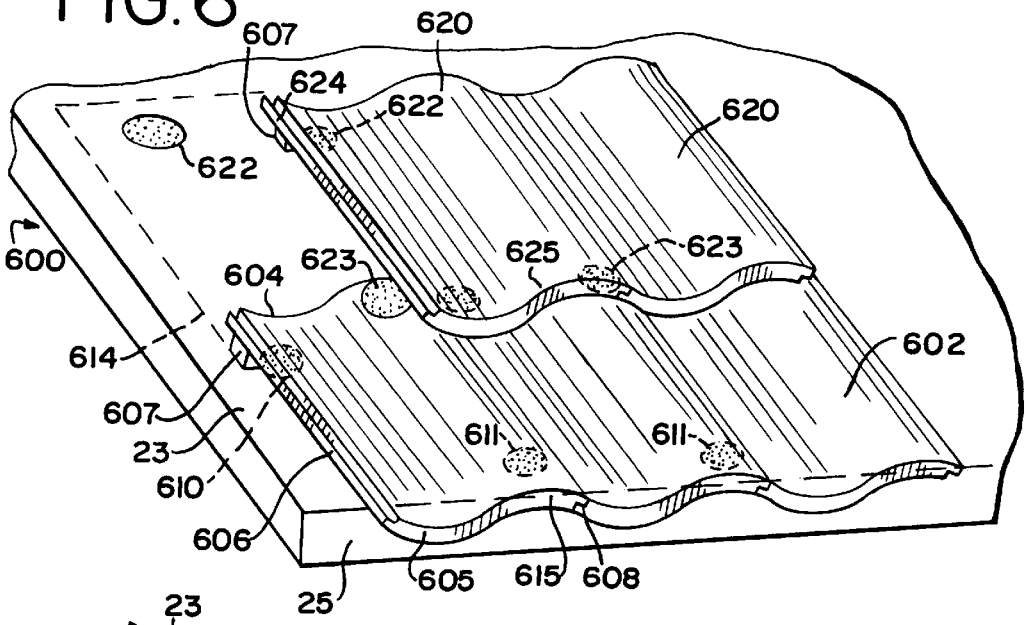
FIG. 6 is a perspective view of a section of a roof illustrating the placement of two courses of roof tiles installed thereon using the present invention as used with S-shaped, high profile roof tiles.
Figure 9:
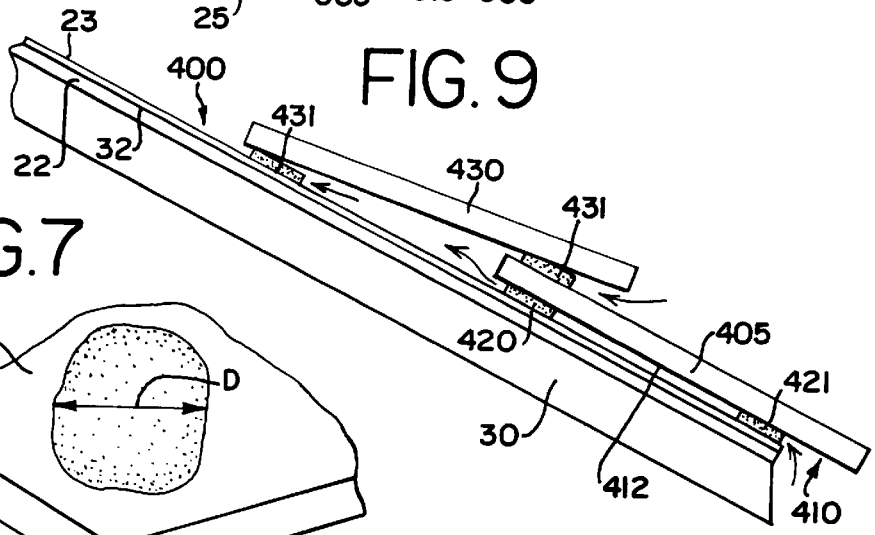
FIG. 9 is a cross-sectional view of FIG. 1.

FIG. 6 illustrates another roof section 600 with a plurality of high profile S-shaped roof tiles similar in style to the "Espana" tiles tested in Test 3 of Table 1. The roof section 600 includes a first set of tiles 602 which have a non-planar configuration and S-shaped profile when viewed from either the leading edge 604 or trailing edge 606 of the tiles 602. Side edges 606 interconnect the leading and trailing edges 604, 605 and preferably include engagement strips 608 disposed therealong. The first tiles 602 are applied to the roof substrate 23 near the eave 25 of the roof 600 by first applying a one-component adhesive in the corner-corner discontinuous pattern of the invention as described above. The tiles 602 illustrated typically may also include anchor lugs 607 formed on their undersurfaces to assist in retention of the tiles 602 on steeply pitched roofs. These anchor lugs 607 will typically engage a batten strip 34. The adhesive deposits 610, 611 in this type application are preferably made in alignment with the opposite corners 614, 615 of the tiles 602 to the extent that they oppose the roof 22 and make contact on the upper end with the anchor lugs 607 and batten strips 34.

A second set of tiles 620 is selected and two additional adhesive deposits 622, 623 are applied in alignment with opposite corners 624, 625 of the tiles 620. As shown in FIG. 6, the adhesive deposits 624, 625 may be applied to the head lap portion of a lower, adjoining first tile 602 and to the roof substrate 23, and the tile is then positioned so that it contacts the adhesive pads 624, 625.

It will be appreciated that the method of applying roof tiles, as described hereinabove, increases the efficiency and reduces the cost for the installation of tile roofs. No complex two-component adhesive foam pressurized supply is needed, and significantly less amounts of foam are used in the application, leading to material cost savings. Additionally, the corner-corner pattern does an unimpeded air channel between the undersurfaces of the tiles and the roof substrate.

It will be appreciated that the embodiments of the present invention which have been discussed are merely illustrative of some of the applications of this invention and that numerous modifications may be made by those skilled in the art without departing from the true spirit and scope of this invention. For example, the adhesive deposits may, in some application, take the form of beads applied in alignment with the leading and trailing edges of the tiles provided they do not subdivide the interstitial areas into discrete subareas. The deposits may also resemble mounds or piles.

We claim:

1. In a roof construction having a substrate and a plurality of roof tiles adhesively affixed to said roof, the roof tiles being arranged in successive rows upon the roof, a first row of said roof tiles being adhesively affixed to said roof, a second row of said roof tiles overlying a portion of said roof and a portion of said roof tile first row, said second row being adhesively affixed to said roof and said roof tiles first row, and at least one subsequent row of roof tiles overlying a portion of said roof and a portion of said roof tiles second row, said roof tile subsequent row being adhesively affixed to said roof and to said roof tile second row, the improvement comprising:

each roof tile being adhesively affixed by a one-component foam adhesive applied to individual roof tiles in a discontinuous, diagonal pattern, the discontinuous diagonal pattern including two distinct deposits of said adhesive positioned on undersurfaces of said individual roof tiles and proximate to opposing corners of said individual roof tiles.

2. The improved roof construction of claim 1, wherein said individual roof tiles are low profile roof tiles having a generally planar exterior configuration.

3. The improved roof construction of claim 1, wherein said individual roof tiles are high profile and have a non-planar exterior configuration.

4. The improved roof construction of claim 1, wherein said high profile roof tiles have an S-shaped configuration when viewed from an end thereof.

5. The improved roof construction of claim 1, wherein said two distinct deposits of said adhesive applied to each of said individual roof tiles have a combined mass of between about 9 grams per roof tile and about 15 grams per roof tile.

6. The improved roof construction of claim 1, wherein said two distinct deposits of said adhesive applied to said individual roof tiles include two distinct pads of said adhesive approximating the size of a tennis ball.

7. The improved roof construction of claim 1, wherein said two distinct deposits of said adhesive applied to said individual roof tiles include two distinct pads of said adhesive approximately 2½ inches in diameter.

8. The improved roof construction of claim 1, wherein said two distinct deposits of said adhesive applied to said individual roof tiles include two piles of said adhesive, each pile of said adhesive having approximate dimension of about 1 inch by about 2 inches by about 3 inches.

9. The improved roof construction of claim 1, wherein said adhesive pattern does not extend between opposing edges of said individual tiles and does not divide said undersurfaces of said individual roof tiles into distinct sections.

10. The improved roof construction of claim 1, wherein said first row of roof tiles are affixed to said roof by contacting both of said two distinct adhesive deposits of each of said roof tiles of said roof tile last row to said substrate.

11. The improved roof construction of claim 10, wherein said second row of roof tiles are affixed to said roof by contacting one of each of said two adhesive deposits of said adhesive applied to said individual roof tiles to said roof substrate and contacting the other of said two adhesive deposits to said first row of roof tiles.

12. In a tile roof construction having a substrate and a plurality of roof tiles adhesively affixed to said roof, each of the roof tiles having opposing top and bottom surfaces, leading and trailing edges and side edges interconnecting the leading and trailing edges, said roof tiles being arranged in successive rows upon the roof, a first row of said roof tiles being adhesively affixed to said roof, a second row of said roof tiles overlying a portion of said roof and a portion of said first row of roof tiles, said second row of roof tiles being adhesively affixed to both said roof and said first row of roof tile, and at least one subsequent row of roof tiles overlying a portion of said roof and a portion of said second row of roof tiles, said subsequent row of roof tiles being adhesively affixed to both said roof and to said second row of roof tiles, the improvement comprising:

each said roof tile being adhesively affixed to said roof by way of a one-component adhesive foam applied in a discontinuous diagonal pattern to said roof and said roof tiles, the discontinuous diagonal pattern including two distinct deposits of said adhesive foam located proximate to opposing corners of said individual roof tiles and in opposition to said bottom surfaces of said roof tiles.

13. The improved tile roof construction of claim 12, wherein said adhesive foam deposits are applied to said bottom surfaces of said roof tiles proximate to said side edges of said roof tiles.

14. The improved tile roof construction of claim 12, wherein said adhesive foam deposits associated with each roof tile have a combined total mass of about between 9 and about 15 grams.

15. An improved roof construction utilizing a plurality of roof tiles adhesively affixed a roof surface, the roof surface having at least one defined eave;

a plurality of roof tiles, each of the roof tiles having opposing leading and trailing edges interconnected by marginal side edges, each of said roof tiles having opposing upper and undersurfaces;

said roof tiles being arranged in successive rows upon said roof surface such that:

a first row of said roof tiles is positioned on said roof surface close to said roof eave so that a portion of said undersurfaces of said first row of said roof tiles oppose said roof surface; and, a second row of said roof tiles is positioned on said roof surface close to said first row of roof tiles so that portions of said second row of roof tiles overlie both said roof surface and said first row of roof tiles;

each of said roof tiles of said first row of roof tiles being adhesively affixed to said roof surface by way of two separate first deposits of a one-component adhesive foam in a diagonal pattern aligned with and proximate to said leading and trailing edges of said undersurfaces of said first roof tiles, said first adhesive deposits adhesively affixing the undersurfaces of said first row roof tiles to said roof surface; and, each of said roof tiles of said second row of roof tiles being adhesively affixed to said roof surface and said first row of roof tiles by way of two separate second deposits of said one-component adhesive foam in a diagonal pattern aligned with and proximate to said leading and trailing edges of said undersurfaces of said second row of roof tiles, said second adhesive deposits adhesively affixing the undersurfaces of said second row roof tiles to said roof surface and to said first row roof tiles.

16. The improved tile roof construction of claim 15, wherein said roof includes an underlayment interposed between said roof and said roof tiles.

17. The roof construction of claim 15, wherein said second adhesive deposits of said second row of roof tiles are aligned with opposing comers of said second row of roof tiles.

18. The roof construction of claim 15, wherein said first and second adhesive deposits of said first and second row of roof tiles have a pad-like configuration having approximate dimensions of about 1 inch by about 2 inches by about 3 inches.

19. The roof construction of claims 15, wherein said first and second adhesive deposits of said first and second row of roof tiles are respectively aligned with opposing marginal side edges of said roof tiles of said first and second rows of roof tiles.

* * * * *